US005848730A

United States Patent [19]

Kawase et al.

[11] Patent Number: 5,848,730

[45] Date of Patent: Dec. 15, 1998

[54] DISCHARGE BOTTLE FOR JETTING TWO AGENTS SIMULTANEOUSLY

[75] Inventors: Jiro Kawase; Makoto Aoki, both of Tokyo, Japan

[73] Assignee: Kao Corporation, Tokyo, Japan

[21] Appl. No.: 790,997

[22] Filed: Jan. 30, 1997

[30] Foreign Application Priority Data

Jan. 31, 1996 [JP] Japan ..... 8-038966

[51] Int. Cl.[6] ..... B65D 35/22

[52] U.S. Cl. ..... 222/94; 132/219; 222/95; 222/102; 222/105; 222/162; 222/192

[58] Field of Search ..... 222/94, 95, 101, 222/102, 105, 162, 405, 137, 319, 192; 132/221

[56] References Cited

U.S. PATENT DOCUMENTS

| | | | |
|---|---|---|---|
| 1,823,206 | 9/1931 | Maher . | |
| 1,989,713 | 10/1935 | Smith et al. . | |
| 2,496,004 | 1/1950 | Geyer | 222/102 |
| 2,655,289 | 10/1953 | Peal | 222/405 X |
| 2,819,723 | 1/1958 | Meyer | 222/94 X |
| 3,187,951 | 6/1965 | Hardman et al. | 222/102 |
| 3,263,862 | 8/1966 | Geyer | 222/101 |
| 3,302,832 | 2/1967 | Hardman et al. | 222/94 |
| 3,608,782 | 9/1971 | Sathicq | 222/94 |
| 3,866,800 | 2/1975 | Schmitt | 222/94 |
| 4,998,645 | 3/1991 | Pearson | 222/162 X |
| 5,137,178 | 8/1992 | Stokes et al. | 222/94 |
| 5,332,124 | 7/1994 | Cancro et al. | 222/137 |
| 5,699,935 | 12/1997 | Stahley | 222/94 |

FOREIGN PATENT DOCUMENTS

| | | |
|---|---|---|
| 0 124 852 | 11/1984 | European Pat. Off. . |
| 1 468 507 | 12/1966 | France . |
| 2 651 485 | 3/1991 | France . |
| 215 509 | 8/1908 | Germany . |
| 814 723 | 9/1951 | Germany . |
| 37 29 491 | 3/1988 | Germany . |
| 89 12 515 | 3/1990 | Germany . |
| 91 01 080 | 5/1991 | Germany . |
| 4-100483 | 8/1992 | Japan . |
| 5-338679 | 12/1993 | Japan . |
| 2 174 356 | 11/1986 | United Kingdom . |

*Primary Examiner*—Kevin P. Shaver
*Attorney, Agent, or Firm*—Oblon, Spivak, McClelland, Maier & Neustadt, P.C.

[57] ABSTRACT

A discharge bottle for discharging different cream or gel matters simultaneously from a plurality of flexible vessels containing the different cream or gel matters respectively, which comprises: a holding vessel in which the plurality of flexible vessels are arranged side by side; at least one discharge hole for discharging the cream or gel matters contained in the plurality of flexible vessels; fitting holes communicated with said discharge hole and fitted to the mouth portions of the flexible vessels arranged side by side in the holding vessel; and pressing members for pressing the plurality of flexible vessels arranged side by side in the holding vessel to thereby simultaneously discharge the different cream or gel matters contained in the flexible vessels respectively. The pressing members may be provided in the form of roller-like pressing members, disk-like pressing members, plate-like pressing members, or the like. According to the discharge bottle, two agents in a two-agent type cosmetic such as a hair dye, or the like, are discharged simultaneously at the time of use, so that the convenience in use of such a two-agent type cosmetic is improved.

11 Claims, 11 Drawing Sheets

DISCHARGE BOTTLE FOR JETTING TWO AGENTS SIMULTANEOUSLY

BACKGROUND OF THE INVENTION

1. Field of the Invention

The present invention relates to a non-aerosol type discharge bottle from which two cream or gel agents contained in flexible vessels respectively can be discharged simultaneously.

2. Description of the Related Art

Heretofore, as a two-agent type cosmetic, there is known a two-agent type hair dye composed of a first agent, for example, containing oxidation dyes, and a second agent, for example, containing an oxidizer such as hydrogen peroxide, or the like. There is further known a two-agent type hair bleach composed of a first agent containing an alkaline compound, and a second agent containing hydrogen peroxide. Besides hair cosmetics such as hair dye, a hair bleach, etc., there is known a two-agent type dentifrice composed of a first agent such as calcium carbonate, or the like, for providing a brushing/cleaning effect, and a second agent containing hydrogen peroxide for providing a bleaching effect.

In the aforementioned two-agent type cosmetic, the first and second agents are contained in flexible vessels such as plastic tubes, tubes of lamination of metal foil and plastic sheet, etc., individually in view of safety of storage, and the cosmetic can be used after the first and send agents are discharged from the respective vessels and mixed with each other.

However, there arises a problem that it is troublesome to squeeze the first and second agents from the flexible vessels respectively and mix them with each other whenever the cosmetic is to be used.

SUMMARY OF THE INVENTION

The present invention is intended to solve the aforementioned problem in the prior art and has an object thereof to provide a two-agent type cosmetic such as a hair dye, or the like, in which two agents are discharged simply simultaneously at the time of use to thereby improve the convenience in use of the two-agent type cosmetic.

To achieve the foregoing object, the present invention provides a non-aerosol type discharge bottle comprising: a plurality of flexible vessels respectively containing liquid matters different from each other and selected from the group consisting of cream and gel matters; a holding vessel in which the plurality of vessels are arranged side by side; at least one discharge hole for discharging the liquid matters; and a pressing means for pressing the flexible vessels to discharge the liquid matters from the flexible vessels through the discharge hole.

Here, various embodiments for pressing the flexible vessels may be used. Basic embodiments of the discharge bottle in which the contents of the flexible vessels are discharged by pressing the flexible vessels are as follows:

(i) A discharge bottle in which the holding vessel holds the plurality of flexible vessels vertically so that the mouth portions of the flexible vessels are put upside; the pressing means includes at least one pair of roller-like pressing members disposed under the flexible vessels held by the holding vessel; and the flexible vessels held by the holding vessel are nipped between and pressed by the pair of roller-like pressing members so that the pair of roller-like pressing members move relatively toward the mouth portions, when the holding vessel is pressed down toward the pair of roller-like pressing members.

(ii) A discharge bottle in which the holding vessel holds the plurality of flexible vessels vertically so that the mouth portions of the flexible vessels are put upside; the pressing means includes a screw-like shaft member erected vertically in the holding vessel, and a disk-like pressing member threadedly-engaged with the screw-like shaft member; and when the screw-like shaft member is rotated around its axis, the disk-like pressing member moves upward from the lower ends of the flexible vessels while the side wall of the disk-like pressing member presses the flexible members against the inner wall of the holding vessel.

(iii) A discharge bottle in which the pressing means includes plate-like pressing members for pressing side surfaces of the flexible vessels disposed side by side in the holding vessel to thereby simultaneously discharge the cream-like or gel-like matters contained in the flexible vessels.

DETAILED DESCRIPTION OF THE PREFERRED EMBODIMENTS

Figure 1A:
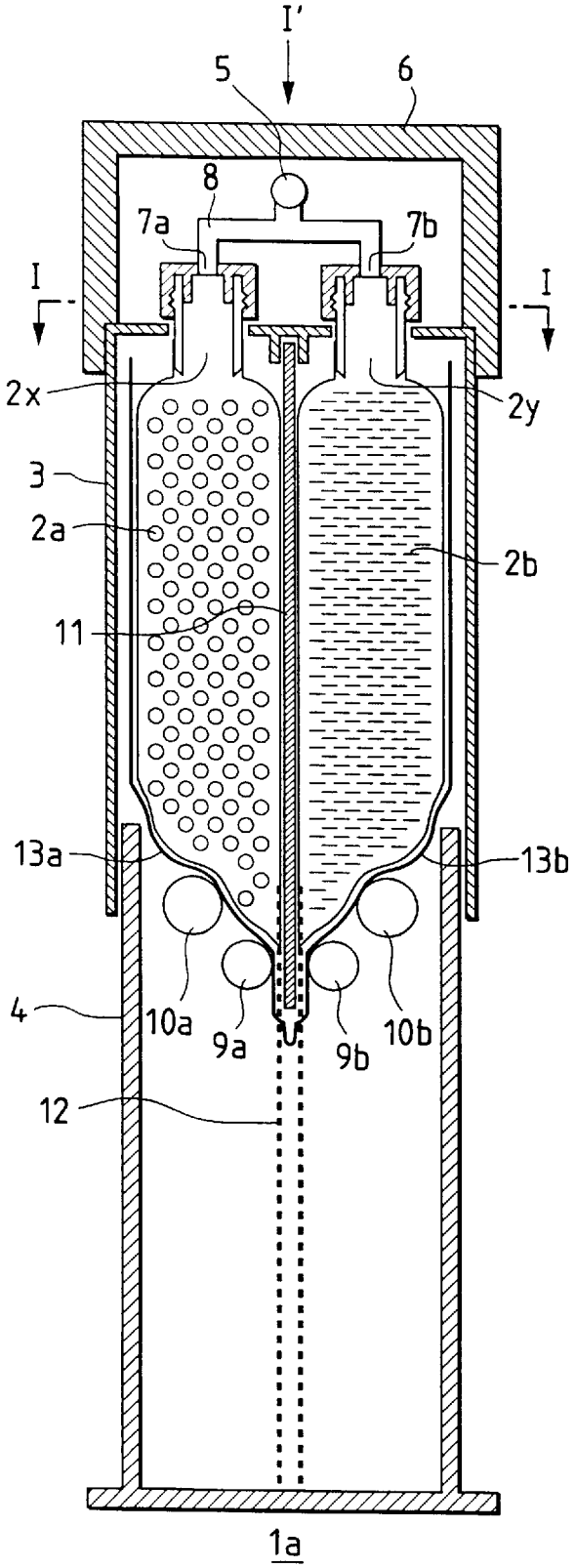
FIG. 1A is a schematic sectional view of a discharge bottle according to a first embodiment of the present invention.

Embodiments of the present invention will be described below with reference to the drawings. In the drawings, the same as or equivalent to each other are referenced correspondingly.

The discharge bottle according to the present invention is designed so that a plurality of flexible vessels respectively containing cream or gel matters different from each other are arranged side by side by a holding vessel and the contents of the flexible vessels are discharged simultaneously by pressing the flexible vessels. As specific embodiments for pressing the flexible vessels, various embodiments may be used so long as the contents of the plurality of flexible vessels can be discharged from the flexible vessels simultaneously.

Figure 1B:
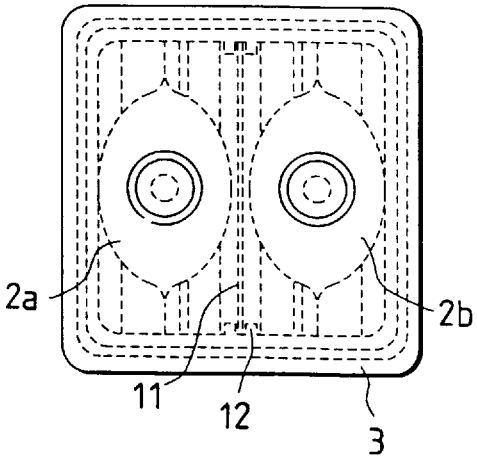
FIG. 1B is a sectional view taken along the line I—I in FIG. 1A.
Figure 1C:
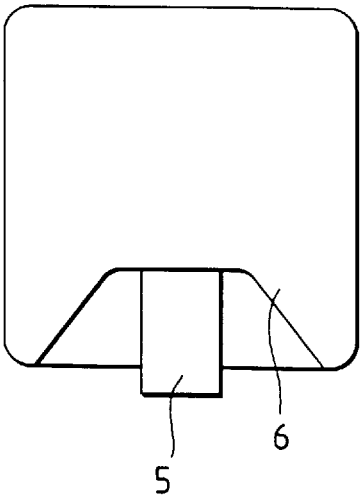
FIG. 1C is a top view from the arrow I' in FIG. 1A.

For example, as embodiments for pressing the flexible vessels, there are used an embodiment in which the contents of the flexible vessels are extruded by pressing the flexible vessels linearly or zonally at end portions opposite to the mouth potions of the flexible vessels so as to cross the body portions of the flexible vessels and by sliding the linearly or zonally pressed portions relatively toward the mouth portions of the flexible vessels, an embodiment in which side surfaces of the flexible vessels are face-pushed, etc. FIGS. 1A to 1C schematically show a discharge bottle according to a first embodiment of the present invention as one of embodiments in which the flexible vessels are pressed to discharge the contents of the flexible vessels in a manner as described above.

In the first embodiment, the discharge bottle 1*a* comprises, in its side, two tube-like (cylindrical) or pouch-like (in the form of a flat bag obtained by sticking one or two sheets) flexible vessels 2*a* and 2*b* , a holding vessel 3 for arranging side by side the flexible vessels 2*a* and 2*b* vertically to put the mouth portions 2*x* and 2*y* of the flexible vessels 2*a* and 2*b* upside, a bottom vessel 4 located under the holding vessel 3 for supporting the holding vessel 3 in an erected state, and a cover 6 provided with a discharge hole 5.

In the inside of the cover 6, fitting holes 7*a* and 7*b* are formed in the mouth portions 2*x* and 2*y* of the flexible vessels 2*a* and 2*b* respectively so as to be communicated, through a discharge passage 8, with the discharge hole 5 provided in the cover 6.

In the inside of the bottom vessel 4, a first pair of roller-like pressing members 9*a* and 9*b* and a second pair of roller-like pressing members 10*a* and 10*b* are provided. The first pair of roller-like pressing members 9*a* and 9*b*are designed to nip the flexible vessels 2*a* and 2*b* arranged side by side in the holding vessel 3 so as to press the flexible vessels intensively whereas the second pair of roller-like pressing members 10*a* and 10*b* are designed to press the flexible vessels 2*a* and 2*b* more loosely than the first pair of roller-like pressing members 9*a* and 9*b*.

In the holding vessel 3, a partition plate 11 is disposed between the two flexible vessels 2*a* and 2*b* . In the bottom vessel 4, a guide 12 is provided for guiding the partition plate 11 so that not only the partition plate 11 can be held vertically but also the two flexible vessels 2*a* and 2*b* can be moved vertically. Examples of the partition plate 11 used herein include, for example, a 1–3 mm thick plate of a resin such as polyvinyl chloride, polyethylene, polypropylene, etc., and a 1–3 mm thick plate of a metal such as aluminum, etc.

Figure 3:
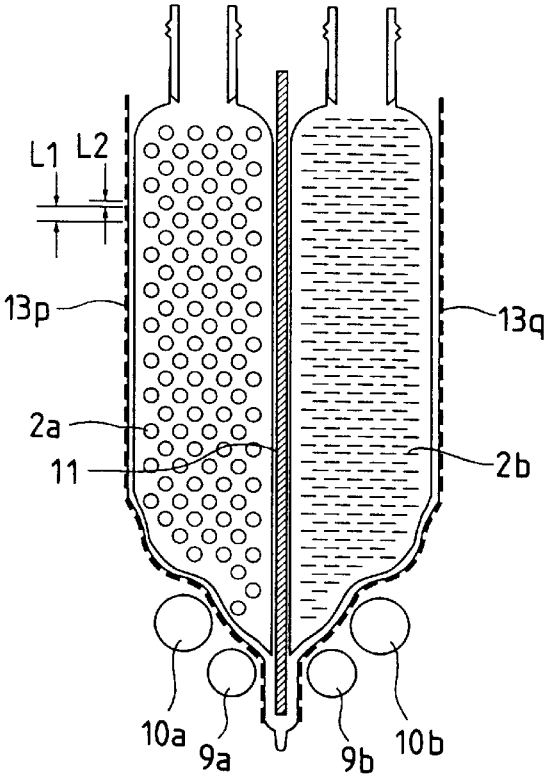
FIG. 3 is a sectional view of a pressing sheet used in the discharge bottle according to the first embodiment of the present invention.

Pressing sheets 13*a* and 13*b* are respectively disposed between the flexible vessel 2*a* and the roller-like pressing members 9*a* and 10*a*, and between the flexible vessel 2*b* and the roller-like pressing members 9*a* and 10*b*. As the pressing sheets 13*a* and 13*b* , for example, polyethylene sheets each having a thickness of from about 0.5 mm to about 3 mm can be used preferably. The pressing sheets 13*a* and 13*b* are not limited to sheets of uniform thickness and drainboard-like sheets 13*p* and 13*q* may be provided as shown in FIG. 3. In this case, it is preferable to prepare the drainboard-like sheets 13*p* and 13*q* in such a manner as follows in order to smoothen the work of pressing the flexible vessels 2*a* and 2*b* as will be described later. The drainboard-like sheets are formed of board-like members each of which is made from resin such as polyethylene, or the like, and has a vertical length L1 (FIG. 3) in a range of from about 2 mm to about 20 mm and a thickness in a range of from about 1 mm to about 3 mm. The board-like members are arranged with intervals L2 in a range of about from 1 mm to 2 mm and adjacent ones of the board-like members are connected to each other through a sheet of resin such polyethylene, or the like, having a thickness in a range of from about 0.5 mm to about 2 mm.

Examples of the flexible vessels arranged side by side in the inside of the holding vessel 3 include, for example, tube or pouch vessels each formed from a plastic sheet or a sheet of lamination of a metal thin film and a plastic sheet. As the contents of the flexible vessels, various cream or gel matters may be used. For example, such contents may be used as the first and second agents in a two-agent type hair dye, a two-agent type hair bleach, a two-agent type dentifrice, or the like.

Figure 2:
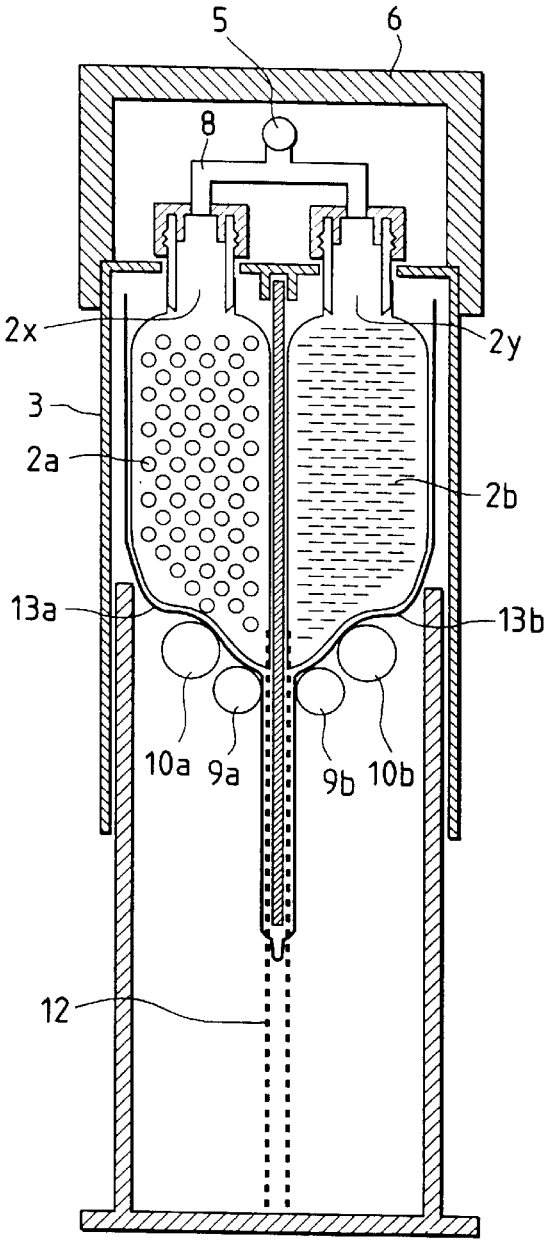
FIG. 2 is a sectional view for explaining the operation of the discharge bottle according to the first embodiment of the present invention.

In use of the discharge bottle 1*a*, as shown in FIG. 1A, the cover 6 is pressed as indicated by the arrow after the flexible vessels 2*a* and 2*b* are contained in the holding vessel 3 and the mouth portions 2*x* and 2*y* of the flexible vessels 2*a* and 2*b* are fitted to the fitting holes 7*a* and 7*a* respectively. As a result, the cover 6 is pressed down as shown in FIG. 2 and, accordingly, the holding vessel 3 is also pressed down. As a result, the flexible vessels 2*a* and 2*b* are inserted into a gap between the first pair of roller-like pressing members 9*a* and 9*b* from the lower end portions of the flexible vessels 2*a* and 2*b* , so that the first pair of roller-like pressing members 9*a* and 9*b* slide relatively toward the mouth portions 2*x* and 2*y* of the flexible vessels 2*a* and 2*b* . Accordingly, the flexible vessels 2*a* and 2*b* are squeezed gradually upward from the lower end portions thereof, so that the contents of the two flexible vessels 2*a* and 2*b* are discharged simultaneously through the discharge hole 5 of the cover 6 in accordance with the amount of pressing against the cover 6. Accordingly, in use of such a two-agent type cosmetic, conventional tiresomeness that two flexible vessels must be squeezed individually can be eliminated.

Incidentally, when the flexible vessels 2*a* and 2*b* are squeezed by using the roller-like pressing members as described above, the second pair of roller-like pressing members 10*a* and 10*b* are not always essential. By providing the second pair of roller-like pressing members 10*a* and 10*b* as shown in FIG. 1A, however, the pressing operation can be carried out smoothly because the flexible vessels 2*a* and 2*b* are pressed loosely by the second pair of roller-like pressing members 10*a* and 10*b* in advance before the flexible vessels 2*a* and 2*b* are squeezed by intensive pressing by means of the first pair of roller-like pressing members 9*a* and 9*b* .

Furthermore, in the discharge bottle according to the first embodiment, the flexible vessels 2*a* and 2*b* are not pressed directly by the first pair of roller-like pressing members 9*a* and 9*b* but pressed through the pressing sheets 13*a* and 13*b* respectively. Accordingly, the pressing operation can be carried out more smoothly. Further, in the case of a pouch formed from a laminate sheet containing an aluminum layer, or the like, as a gas barrier layer, there is a risk that the gas barrier layer may be ruptured in the inside of the laminate sheet correspondingly to the pressing condition when the surface of the pouch is pressed by rollers. By using the pressing sheets 13*a* and 13*b*, however, the aforementioned rupture of the gas barrier layer can be prevented. Furthermore, by using drainboard-like sheets 13*p* and 13*q* shown in FIG. 3 as the pressing sheets, the pressing operation can be carried out more smoothly and more efficiently because the flexible vessels 2*a* and 2*b* can be pressed along the external shape of the drainboard-like sheets 13*p* and 13*q* so that the amounts of the contents remaining in the pressed regions of the flexible vessels 2*a* and 2*b* can be reduced greatly.

Figure 4A:
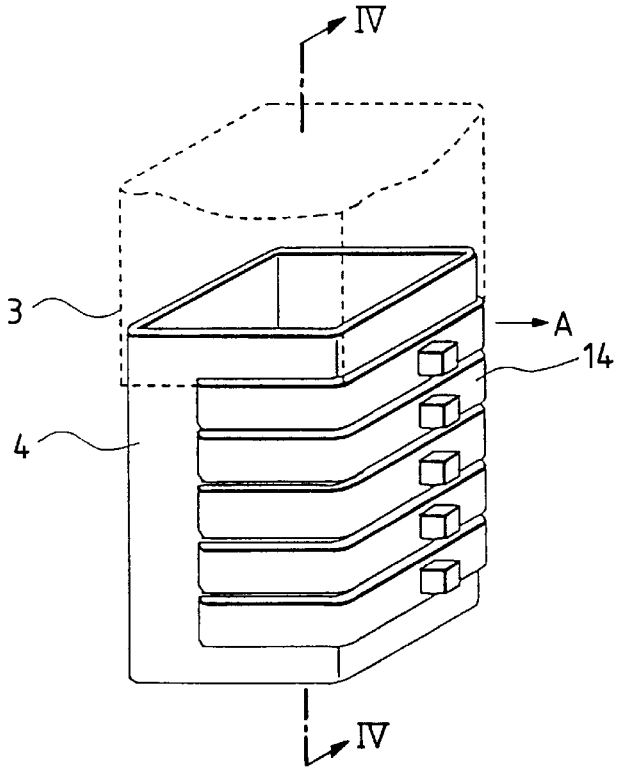
FIG. 4A is a perspective view of a stopper tensile-ring-including bottom vessel used in the discharge bottle according to the first embodiment of the present invention.
Figure 4B:
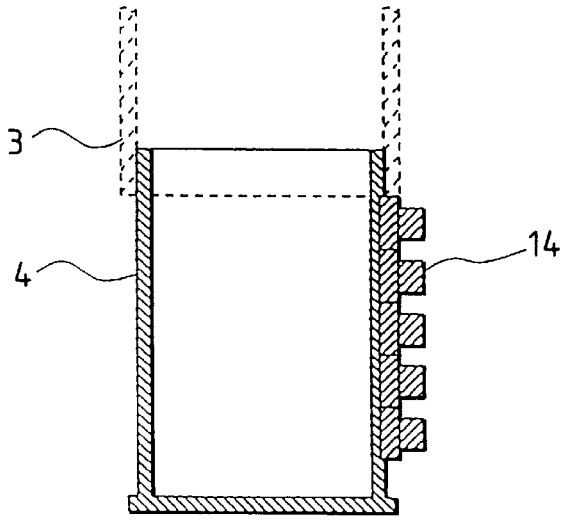
FIG. 4B is a sectional view taken along the line IV—IV in FIG. 4A.
Figure 5A:
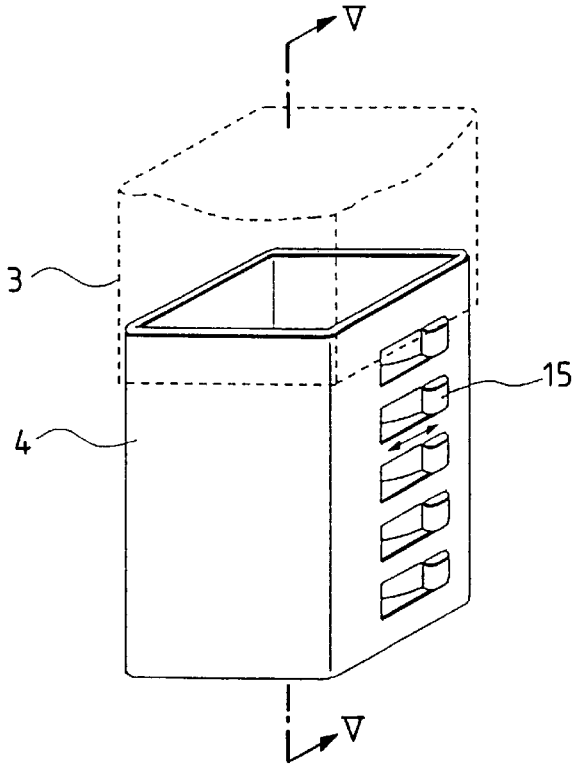
FIG. 5A is a perspective view of a stopper projection-including bottom vessel used in the discharge bottle according to the first embodiment of the present invention.
Figure 5B:
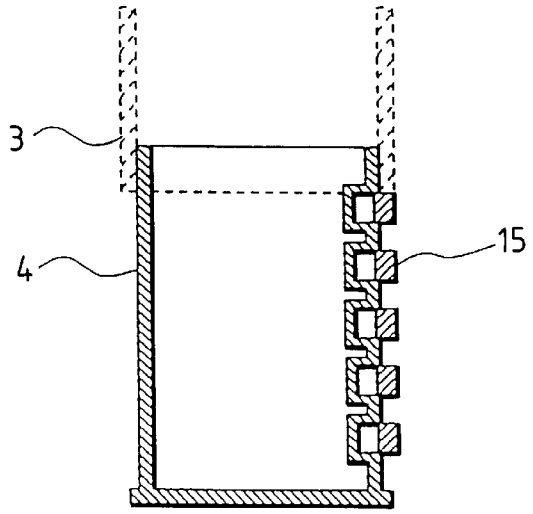
FIG. 5B is a sectional view taken along the line V—V in FIG. 5A.
Figure 6A:
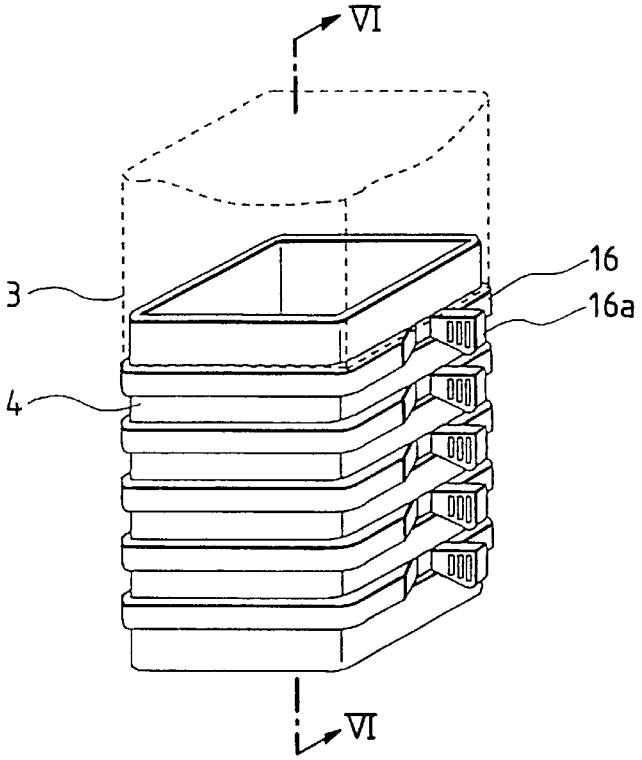
FIG. 6A is a perspective view of a stopper pluck-ring-including bottom vessel used in the discharge bottle according to the first embodiment of the present invention.
Figure 6B:
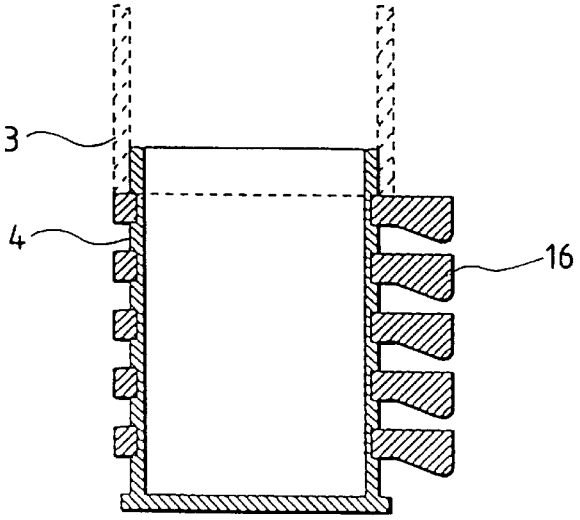
FIG. 6B is a sectional view taken along the line VI—VI in FIG. 6A.

When the cover 6 is pressed down to discharge the contents of the two flexible vessels 2*a* and 2*b* simultaneously through the discharge hole 5 as described above, the amounts of the discharged contents are preferably controlled by pressing down the cover 6 gradually by predetermined amounts. Specifically, for example, as shown in FIGS. 4A and 4B, stopper tensile rings 14 can be provided multistageously in the bottom vessel 4. Each of the stopper tensile rings 14 can be removed from the bottom vessel 4 by pulling as indicated by the arrow A. Alternatively, as show in FIGS. 5A and 5B, stopper projections 15 can be provided in the bottom vessel 4. Each of the stopper projections 15 is designed so that the projection 15 is projected from a side wall surface of the bottom vessel 4 or put into the side wall by sliding as indicated by the arrow. Alternatively, as show in FIGS. 6A and 6B, stopper pluck rings 16 can be provided in the bottom vessel 4. Each of the pluck rings 16 is designed so that the ring 16 per se can be plucked from the bottom vessel 4 by turning its knob 16*a*.

In the discharge bottle 1*a*, a check-valve can be further provided in the discharge passage 8 between the fitting holes 7*a* and 7*a* and the discharge hole 5, if necessary.

Figure 7A:
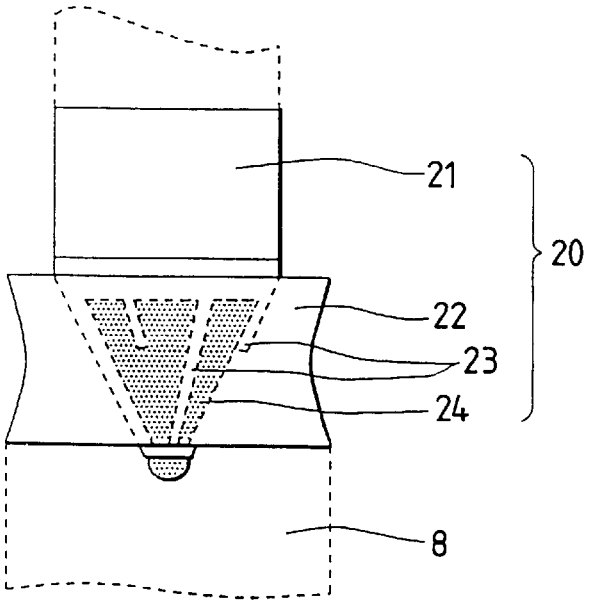
FIG. 7A is a side view of a check-valve used in the discharge bottle according to the first embodiment of the present invention.
Figure 7B:
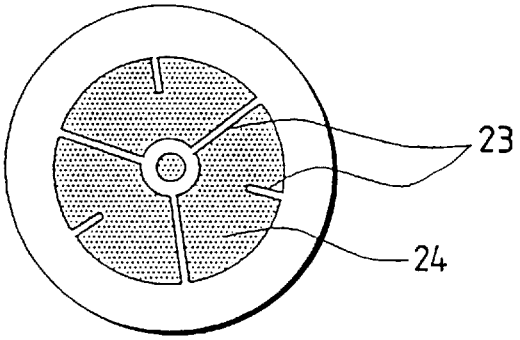
FIG. 7B is a bottom view of the check-valve.
Figure 7C:
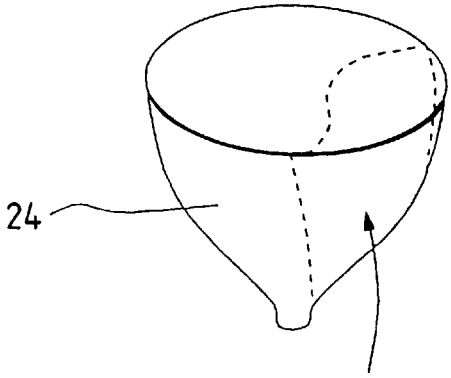
FIG. 7C is a view for explaining an elastic valve acting as the check-valve.

As the check-valve, various known valves may be used. For example, such a check-valve 20 as shown in FIGS. 7A and 7B may be used. The check-valve 20 is constituted by a small-diameter cylindrical member 21, a large-diameter cylindrical member 22, long and short beam-like members 23 formed alternately so as to project from the joint portion of these cylindrical members toward the axial center of the large-diameter cylindrical member 22, and an elastic valve 24 fitted to the small-diameter cylindrical member 21 side of the beam-like members 23. Here, ends of the long beam-like members 23 are connected to a ring. Further, the elastic valve 24 substantially has a shape as indicated by the solid line in FIG. 7C and is fitted to the small-diameter cylindrical member 21 side of the beam-like members 23. The elastic valve 24 is, however, designed so as to be deformed as indicated by the broken line in FIG. 7C when pressed as indicated by the arrow in FIG. 7C while the elastic valve 24 is restored to its original shape when the pressing is released.

Figure 8:
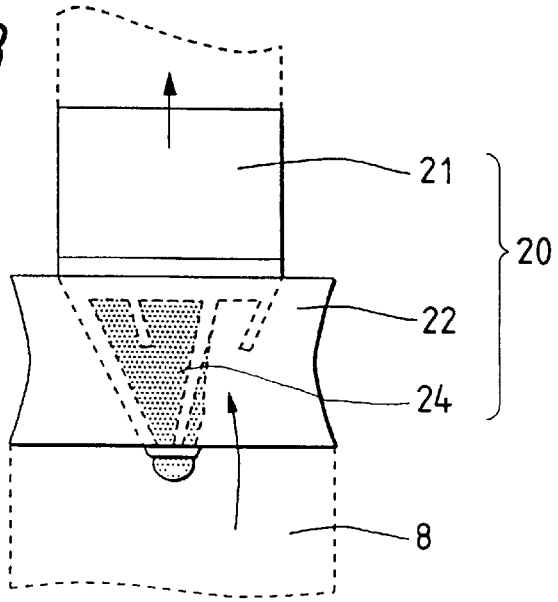
FIG. 8 is a view for explaining the operation of the check-valve used in the discharge bottle according to the first embodiment of the present invention.

Accordingly, in the case where the check-valve 20 is provided in the discharge passage 8 of the discharge bottle 1*a* in FIG. 1A so that the small-diameter cylindrical member 21 is located in the discharge hole 5 side of the discharge bottle 1*a* whereas the large-diameter cylindrical member 22 is located in the fitting hole 7*a* or 7*a* side, the content of either of the flexible vessels 2*a* and 2*b* presses the elastic valve 24 and passes through the check-valve 20 as indicated by the arrow in FIG. 8 so as to be discharged through the discharge hole 5 when the flexible vessels 2*a* and 2*b* are squeezed from its lower end portions. On the other hand, the content discharged from either of the flexible vessels 2*a* and 2*b* is prevented from returning to the flexible vessel 2*a* or 2*b* . Accordingly, even after the flexible vessels 2*a* and 2*b* are attached into the discharge bottle 1*a*, the contents of the flexible vessels 2*a* and 2*b* can be preserved stably.

The aforementioned embodiment of the discharge bottle in which the flexible vessels are pressed by using the roller-like pressing members can be modified variously.

Figure 9:
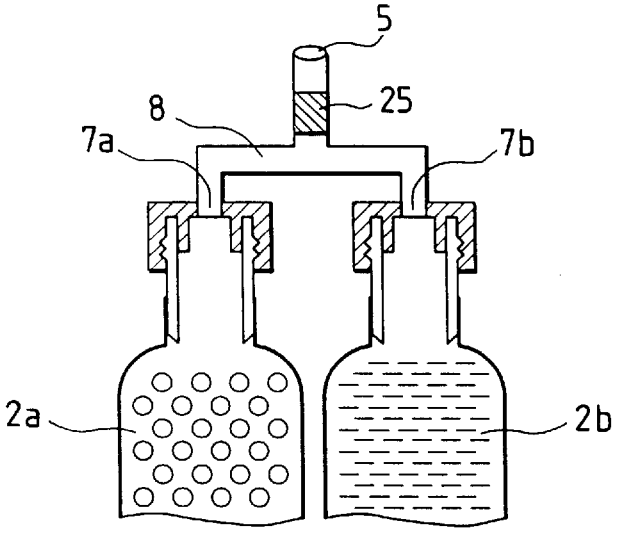
FIG. 9 is a view for explaining a first modification of the neighborhood of the discharge hole in the discharge bottle according to the first embodiment of the present invention.

Although FIG. 1A has shown the case where the contents discharged from the mouth portions 2*x* and 2*y* of the two flexible vessels 2*a* and 2*b* are brought into contact with each other in the discharge passage 8 of the discharge bottle 1*a* before reaching the discharge hole 5 of the discharge bottle 1*a* so that the contents are discharged in a slightly mixed state through the discharge hole 5, if necessary, the invention can be applied to the case where a mixing means 25 is provided in the discharge passage 8 as shown in FIG. 9 so that the contents of the two flexible vessels 2*a* and 2*b* are discharged in a sufficiently mixed state through the discharge hole 5. As the mixing means, for example, there can be used a means formed by providing helical plates having inclinations reverse to each other with respect to the center of the axis.

Figure 10:
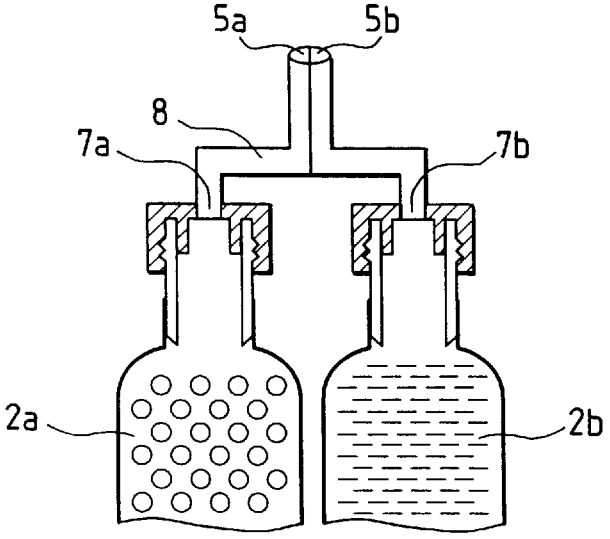
FIG. 10 is a view for explaining a second modification of the neighborhood of the discharge hole in the discharge bottle according to the first embodiment of the present invention.

The invention can be applied also to the case where the discharge bottle is contrariwise designed so that the contents of the two flexible vessels 2*a* and 2*b* are first mixed just before they are discharged through the discharge hole 5. In this case, for example, as shown in FIG. 10, the discharge passage 8 may be divided into two channels in its inside so that the contents are discharged through adjacent discharge holes 5*a* and 5*b* respectively. Alternatively, as shown in FIG.

Figure 12:
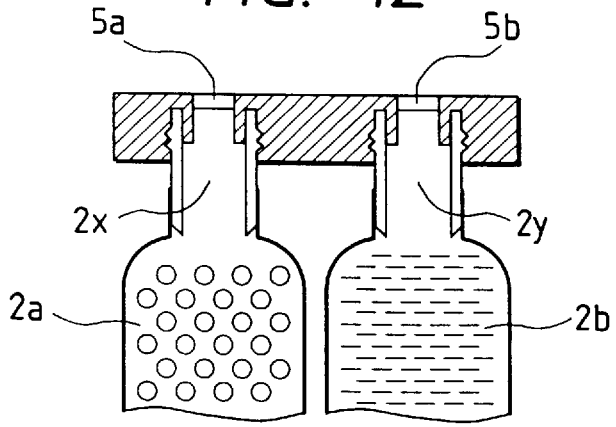
FIG. 12 is a view for explaining a fourth modification of the neighborhood of the discharge hole in the discharge bottle according to the first embodiment of the present invention.

11, the discharge bottle may be designed so that the contents of the two flexible vessels 2*a* and 2*b* are discharged through discharge holes 5*a* and 5*b* of discharge passages 8*a* and 8*b* provided quite separately. In this case, as shown in FIG. 12, the discharge holes 5*a* and 5*b* of the discharge bottle may be made to serve as fitting holes 7*a* and 7*a* for fitting the mouth portions 2*x* and 2*y* of the flexible vessels 2*a* and 2*b* so that the discharge passage 8 can be omitted.

Figure 13A:
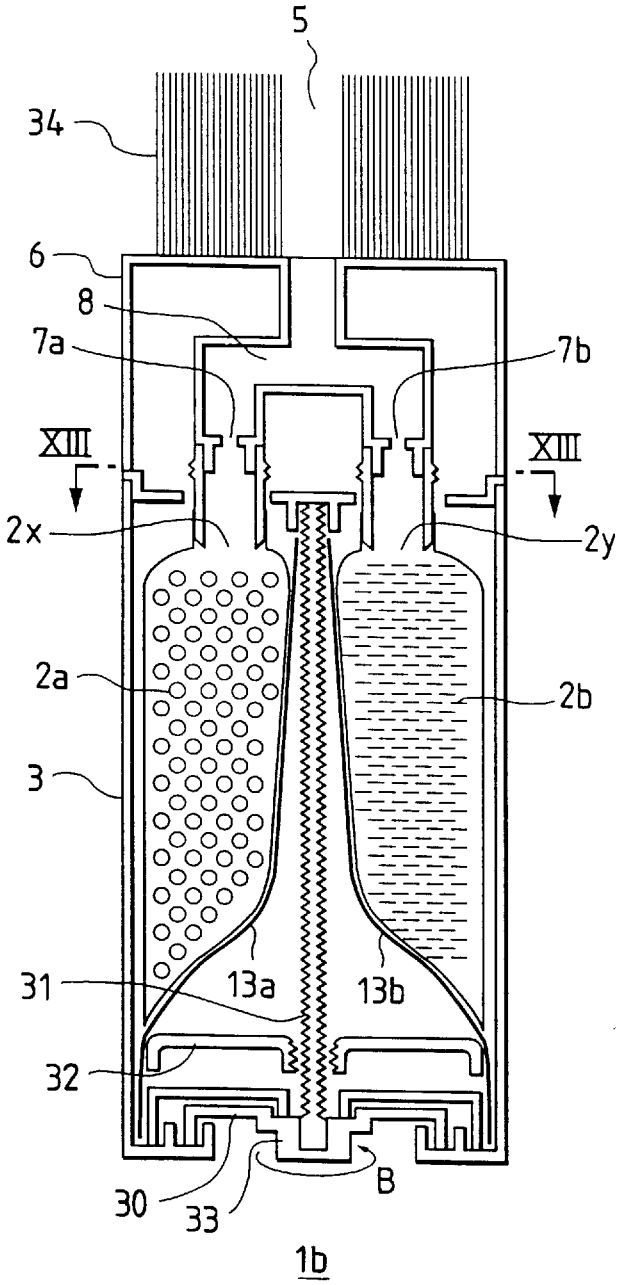
FIG. 13A is a schematic sectional view of a discharge bottle according to a second embodiment of the present invention.
Figure 13B:
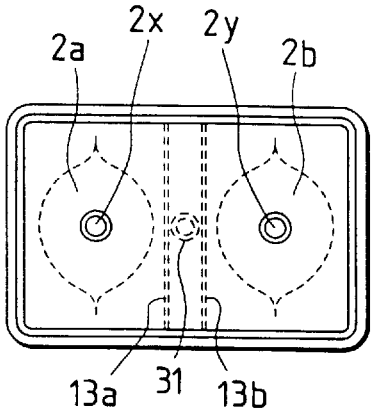
FIG. 13B is a sectional view taken along the line XIII—XIII in FIG. 13A.
Figure 14:
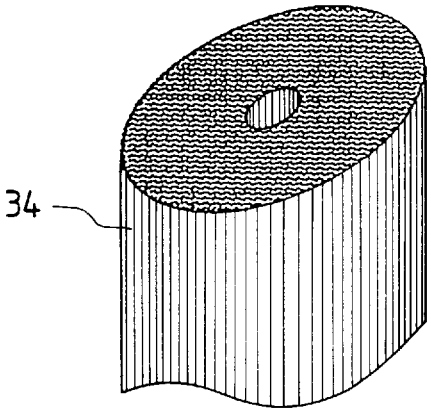
FIG. 14 is a view for explaining a coater used in the discharge bottle according to the second embodiment of the present invention.

FIGS. 13A and 13B are schematic views for explaining a discharge bottle 1*b* according to a second embodiment different from the discharge bottle 1*a* according to the first embodiment in the pressing members and mechanism for pressing the flexible vessels 2*a* and 2*b* . FIG. 14 is a view for explaining a coater provided in the neighborhood of the discharge hole 5 in the cover 6 in the second embodiment.

Also in the second embodiment, the discharge bottle 1*b* is designed so that the flexible vessels 2*a* and 2*b* are arranged vertically and side by side in the holding vessel 3 and the mouth portions 2*x* and 2*y* of the flexible vessels 2*a* and 2*b* are put upside. Further, in the inside of the cover 6, fitting holes 7*a* and 7*a* which are fitted to the mouth portions 2*x* and 2*y* of the flexible vessels 2*a* and 2*b* respectively are formed so as to be communicated, through the discharge passage 8, with the discharge hole 5 provided in the cover 6.

In the discharge bottle 1*b* of the second embodiment, a screw-like shaft member 31 is erected vertically in the center portion of the holding vessel 3 so as to be disposed in a range of from the bottom 30 to the upper end of the holding vessel 3. A disk-like pressing member 32 is movably threadedly-engaged with the screw-like shaft member 31. The disk-like pressing member 32 is moved up by rotating a knob portion 33 in the center of the bottom 30 as indicated by the arrow B in FIG. 13A.

Further, in the inside of the holding vessel 3, pressing sheets 13*a* and 13*b* are disposed between the flexible vessels 2*a* and 2*b* contained in the holding vessel 3 and the disk-like pressing member 32.

Further, in the cover 6, animal bristles 34 are provided as a coater over a considerable range on the periphery of the discharge hole 5.

In use of the discharge bottle 1*b*, as shown in FIG. 13A, the flexible vessels 2*a* and 2*b* are received in the holding vessel 3, the mouth portions 2*x* and 2*y* of the flexible vessels 2*a* and 2*b* are fitted to the fitting holes 7*a* and 7*a* and the knob portion 33 of the bottom 30 is rotated as indicated by the arrow B. As a result, the side wall of the disk-like pressing member 32 moves up from the lower ends of the flexible vessels 2*a* and 2*b* while pressing the flexible vessels 2*a* and 2*b* against the inner wall of the holding vessel 3 through the pressing sheets 13*a* and 13*b*. Accordingly, the flexible vessels 2*a* and 2*b* are squeezed gradually from the lower end portions thereof, so that the contents of the flexible vessels 2*a* and 2*b* are discharged simultaneously through the discharge hole 5 of the cover 6 correspondingly to the quantity of the movement of the disk-like pressing member 32. Accordingly, also by using the disk-like pressing member 32 to press the flexible vessels 2*a* and 2*b* , the conventional tiresomeness that two flexible vessels must be squeezed individually at the time of use of a two-agent type cosmetic can be eliminated. Furthermore, because the animal bristles 34 are provided in the periphery of the discharge hole 5, the discharged contents can be applied onto a subject easily.

Figure 11:
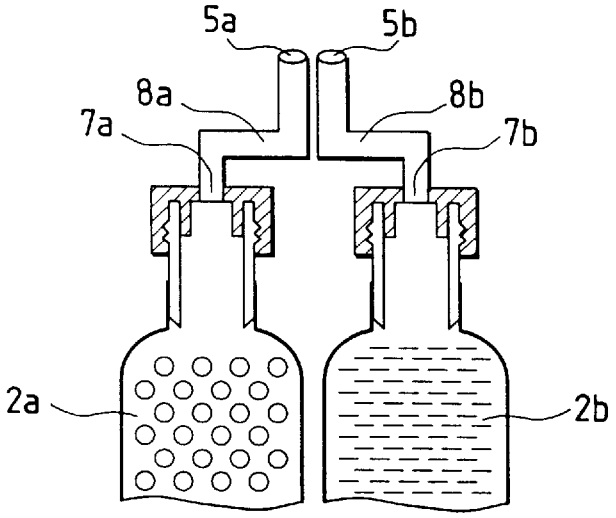
FIG. 11 is a view for explaining a third modification of the neighborhood of the discharge hole in the discharge bottle according to the first embodiment of the present invention.

The discharge bottle 1*b* of the second embodiment shown in FIG. 13A can be also modified variously. For example, drainboard-like sheets can be used as the pressing sheets 13*a* and 13*b* in the same manner as in the discharge bottle 1*a* of the first embodiment shown in FIG. 1A. Further, a check-valve 20 as shown in FIGS. 7A to 8 can be provided in the discharge passage 8 and a mixing means 25 as shown in FIG. 9 can be provided. Further, if necessary, independent discharge holes 5*a* and 5*b* may be provided so as to be adjacent to each other as shown in FIG. 10 so that the contents of the two flexible vessels 2*a* and 2*b* are first mixed just before they are discharged. Further, as shown in FIGS. 11 and 12, the discharge bottle may be designed so that the contents of the two flexible vessels 2*a* and 2*b* are discharged quite separately through discharge holes 5*a* and 5*b*.

Figure 15:
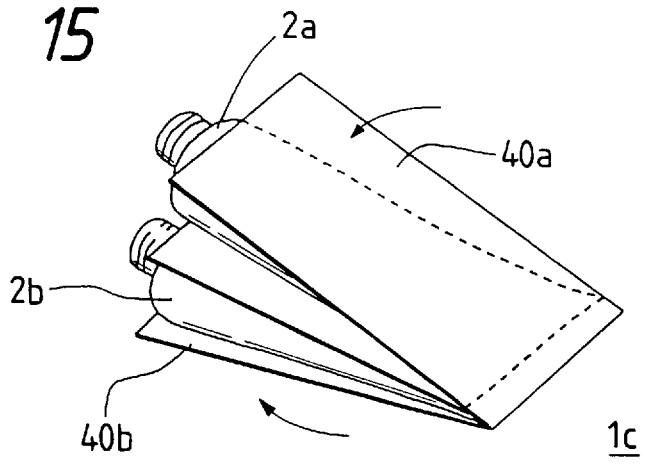
FIG. 15 is a view for explaining a pressing mechanism in a discharge bottle according to a third embodiment of the present invention.

FIG. 15 is a view for explaining a pressing mechanism portion of a discharge bottle 1*c* according to a third embodiment further different from the discharge bottles 1*a* and 1*b* of the first and second embodiments in the pressing means and mechanism for pressing the flexible vessels 2*a* and 2*b* . The discharge bottle 1*c* of the third embodiment is designed so that the two flexible vessels 2*a* and 2*b* are arranged so as to be superimposed on each other between plate-like pressing members 40*a* and 40*b* and the contents of the two flexible vessels 2*a* and 2*b* are discharged simultaneously when side surfaces of the flexible vessels 2*a* and 2*b* are face-pressed by the plate-like members 40*a* and 40*b* as indicated by the arrow.

Figure 16:
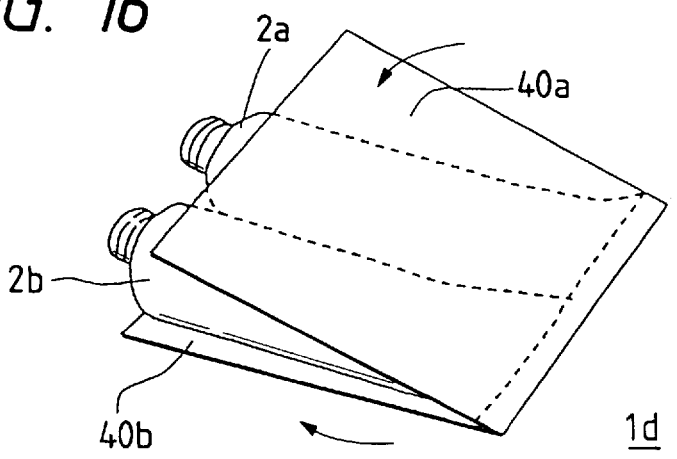
FIG. 16 is a view for explaining a pressing mechanism in a discharge bottle according to a fourth embodiment of the present invention.

FIG. 16 is a view for explaining a pressing mechanism of a discharge bottle 1*d* according to a fourth embodiment in which the contents of the flexible vessels 2*a* and 2*b* are discharged simultaneously when side surfaces of the flexible vessels 2*a* and 2*b* are face-pressed by the plate-like pressing member 40*a* and 40*b* in the same manner as in FIG. 15. The difference of the fourth embodiment from the third embodiment is in that the two flexible vessels 2*a* and 2*b* are arranged side by side between the plate-like pressing members 40*a* and 40*b*.

Figure 17A:
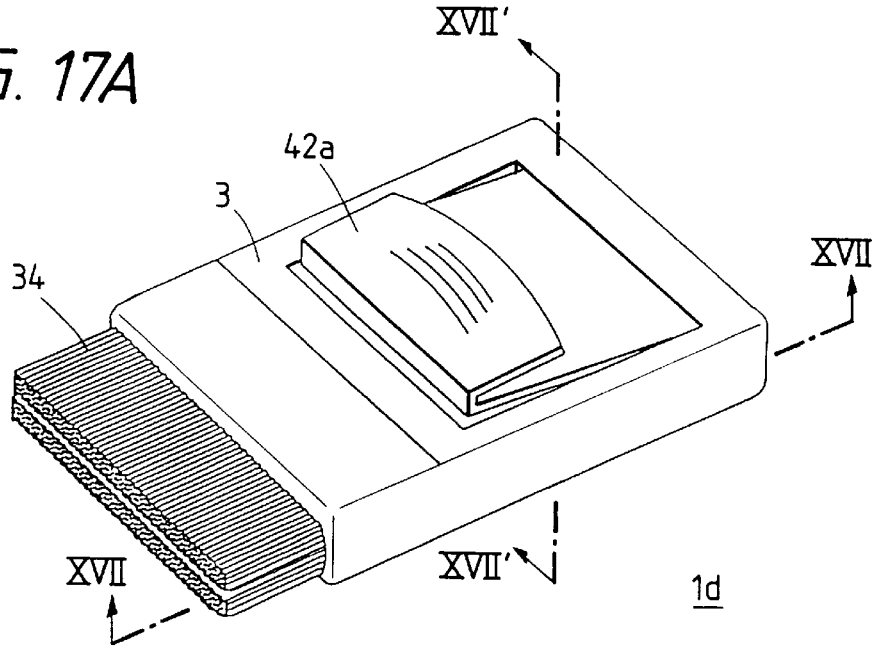
FIG. 17A is a perspective view of a modification of the discharge bottle according to the fourth embodiment of the present invention.
Figure 17B:
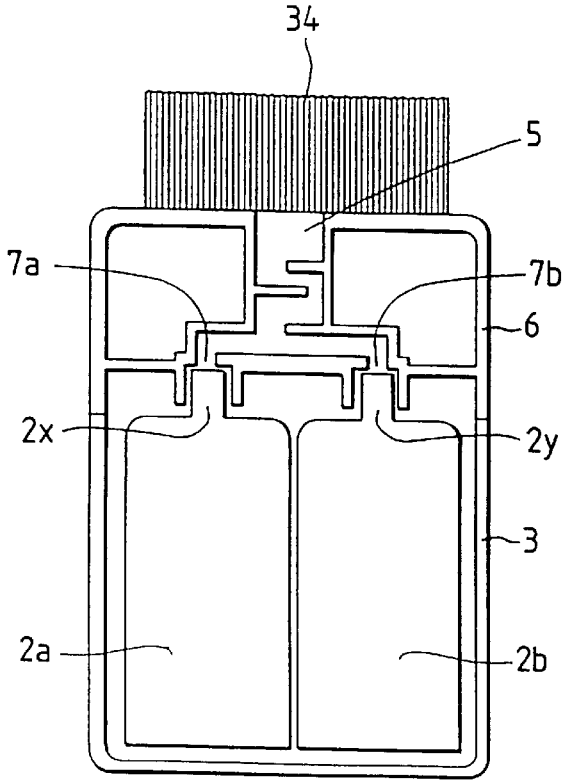
FIG. 17B is a sectional view taken along the line XVII—XVII in FIG. 17A.
Figure 17C:
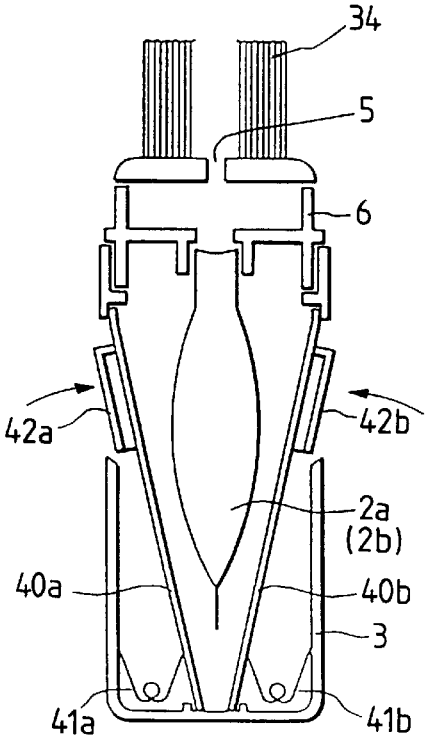
FIG. 17C is a sectional view taken along the line XVII'—XVII' in FIG. 17A.

Also in the case where side surfaces of the flexible vessels 2*a* and 2*b* are face-pressed by using the plate-like pressing members 40*a* and 40*b* like in the case of the discharge bottles 1*c* and 1*d* of the third and fourth embodiments, the discharge passage and the discharge hole can be configured in the same manner like in the case of the discharge bottles 1*a* and 1*b* of the first and second embodiments. As a specific configuration, for example, the discharge bottle 1*d* of the fourth embodiment may be configured as shown in FIGS. 17A to 17C.

That is, the discharge bottle 1*d* of the fourth embodiment is designed so that the flexible vessels 2*a* and 2*b* are arranged side by side between the plate-like pressing members 40*a* and 40*b* provided in the holding vessel 3. Because spring materials 41*a* and 41*b* are provided between the plate-like pressing members 40*a* and 40*b* and the inner wall of the holding vessel 3, the plate-like pressing members 40*a* and 40*b* are always brought nearly into contact with side surfaces of the flexible vessels 2*a* and 2*b* arranged side by side in the holding vessel 3. Further, pressing portions 42*a* and 42*b* connected to the plate-like pressing members 40*a* and 40*b* respectively as shown in FIG. 17C are exposed on side surfaces of the holding vessel 3. On the other hand, the mouth portions 2*x* and 2*y* of the flexible vessels 2*a* and 2*b* arranged side by side in the holding vessel 3 are fitted to the fitting holes 7*a* and 7*a* communicated with the discharge hole 5 of the cover 6 in the discharge bottle 1*d*. Accordingly, the two flexible vessels 2*a* and 2*b* are nipped and face-pressed simultaneously by means of the plate-like pressing members 40*a* and 40*b* by pressing the pressing portions 42*a* and 42*b* as indicated by the arrow in FIG. 17C, so that the contents of the two flexible vessels 2*a* and 2*b* are discharged simultaneously through the discharge hole 5. Furthermore, because the animal bristles 34 are provided in the periphery of the discharge hole 5, the discharged contents can be applied onto a subject easily.

Although various embodiments of the discharge bottle according to the present invention have been described above with reference to the drawings, various changes of the invention may be made. Although the aforementioned embodiments have been described about the case where, for example, the number of flexible vessels arranged side by side in the holding vessel is two so that the contents of the two flexible vessels are discharged simultaneously, the invention can be applied also to the case where three or more flexible vessels are arranged side by side in the holding vessel, if necessary, so that the contents thereof are discharged simultaneously. In this case, one discharge hole may be provided in the discharge bottle or a plurality of discharge holes may be provided in the discharge bottle.

Figure 18:
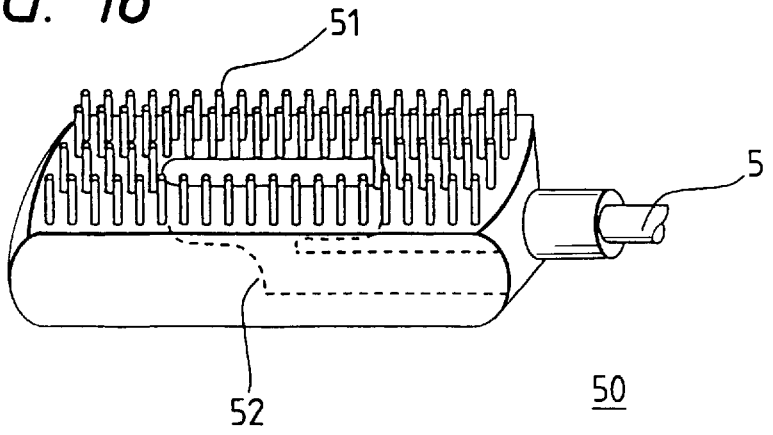
FIG. 18 is a view for explaining a comb-like coater which can be attached to the discharge bottle according to the present invention.

Various coaters other than the aforementioned animal bristles may be attached to the end of the discharge hole in the discharge bottle according to the present invention, if necessary. For example, in the case where flexible vessels for a two-agent type hair dye are put in the discharge bottle according to the present invention, a comb-like coater 50 is preferably attached to the end portion of the discharge hole 5 in the discharge bottle as shown in FIG. 18. In the comb-like coater 50, an opening portion 52 is provided between comb teeth 51 so as to be communicated with the discharge hole 5, so that two agents in the two-agent type hair dye are discharged simultaneously through the opening portion 52. The hair dying operation can be carried out more simply by using such a coater 50 attached to the discharge bottle according to the present invention.

According to the preset invention, two agents in a two-agent type cosmetic such as a hair dye, or the like, can be discharged simultaneously in use, so that the convenience in use of the two-agent type cosmetic can be improved greatly.

What is claimed is:

1. A non-aerosol discharge bottle comprising:

a first flexible vessel containing first liquid matter;

a second flexible vessel containing second liquid matter different from said first liquid matter;

a holding vessel in which said first and second flexible vessels are arranged side by side;

at least one discharge hole which is connected to said first and second flexible vessels and through which said first and second liquid matter are discharged; and a pressing member including first and second pair of rollers and adapted to press said first and second flexible vessels to discharge said first and second liquid matter from said first and second flexible vessels through said at least one discharge hole, said first and second flexible vessels being nipped between said first pair of rollers, said second pair of rollers being arranged between said at least one discharge hole and said first pair of rollers such that a distance between said second pair of rollers is larger than that between said first pair of rollers.

2. A non-aerosol discharge bottle according to claim 1, wherein said first and second flexible vessels contain cream or gel matter.

3. A non-aerosol discharge bottle according to claim 1, wherein said holding vessel together with said first and second flexible vessels is movable toward said pressing member.

4. A non-aerosol discharge bottle according to claim 3, further comprising:

a bottom vessel which supports said holding vessel and along which said holding vessel is movable; and a stopper which limits a movement of said holding vessel along said bottom vessel.

5. A non-aerosol discharge bottle according to claim 1, wherein said first flexible vessel contains the first liquid matter including oxidation dyes of a two-agent oxidation dye, and said second flexible vessel contains the second liquid matter including hydrogen peroxide of the two-agent oxidation dye.

6. A non-aerosol discharge bottle according to claim 5, further comprising:

a comb-shaped coater connected to said at least one discharge hole.

7. A non-aerosol discharge bottle according to claim 1, wherein said first flexible vessel contains the first liquid matter including alkaline matter of a two-agent decolorizer, and said second flexible vessel contains the second liquid matter including hydrogen peroxide of the two-agent decolorizer.

8. A non-aerosol discharge bottle according to claim 7, further comprising:

a comb-shaped coater connected to said at least one discharge hole.

9. A non-aerosol discharge bottle comprising:

a first flexible vessel containing first liquid matter;

a second flexible vessel containing second liquid matter different from said first liquid matter;

a holding vessel in which said first and second flexible vessels are arranged side by side;

at least one discharge hole which is connected to said first and second flexible vessels and through which said first and second liquid matter is discharged;

a pressing member adapted to press said first and second flexible vessels to discharge said first and second liquid matter from said first and second flexible vessels through said at least one discharge hole; and a sheet arranged between said pressing member and said first and second flexible vessels, said sheet having a drainboard shape, said pressing member pressing said first and second flexible vessels via said sheet.

10. A non-aerosol discharge bottle according to claim 9, wherein said sheet includes plural board members which are connected to each other.

11. A non-aerosol discharge bottle according to claim 9, wherein said sheet is made from resin.

* * * * *